US005141271A

United States Patent [19]

Geringer et al.

[11] Patent Number: 5,141,271

[45] Date of Patent: Aug. 25, 1992

[54] ALIGNMENT DEVICE FOR ELECTROMAGNETIC DOOR LOCK

[76] Inventors: Arthur Geringer, 5029 E. Jacobs Ct., Agoura, Calif. 91301; Richard Geringer, 12628 Ambermeadow, Moorpark, Calif. 93021; David Geringer, 28364 Balkin, Agoura, Calif. 91301

[21] Appl. No.: 763,779

[22] Filed: Sep. 23, 1991

[51] Int. Cl.[5] ..... E05B 47/00

[52] U.S. Cl. ..... 292/251.5

[58] Field of Search ..... 292/251.5, 201, DIG. 71, 292/144

[56] References Cited

U.S. PATENT DOCUMENTS

| | | | |
|---|---|---|---|
| 3,350,127 | 3/1965 | Hekelaar | 292/251.5 |
| 3,794,366 | 2/1974 | Graham | 292/251.5 |
| 4,257,631 | 3/1981 | Logan, Jr. | 292/251.5 |
| 4,401,346 | 8/1983 | Jones et al. | 292/144 |
| 4,439,808 | 3/1984 | Gillham | 361/144 |
| 4,487,439 | 12/1984 | McFadden | 292/251.5 |
| 4,652,028 | 3/1987 | Logan et al. | 292/251.5 |
| 4,720,128 | 1/1988 | Logan, Jr. et al. | 292/251.5 |
| 4,826,223 | 5/1989 | Geringer et al. | 292/251.5 |
| 5,016,929 | 5/1991 | Frolov | 292/251.5 |

*Primary Examiner*—Richard E. Moore
*Attorney, Agent, or Firm*—John J. Posta, Jr.

[57] ABSTRACT

The device includes an electromagnet securing means for holding the electromagnet in a door frame, an electrical conduit connecting the electromagnet to a power source, an armature magnetically attracted to the electromagnet when the latter is energized, and a connector for holding the armature on a door edge for adjustable movement towards the electromagnet. When the armature and electromagnet are in line with each other, the armature is free to move toward the electromagnet. Unlocking is effected by deenergizing the electromagnet and allowing the armature to retract by gravity or spring action, so that the lock component also moves out of the desired engagement. A switch in the bottom of the electromagnet is normally open but is magnetically attracted into the closed position only when the armature is fully aligned therewith by a magnet located in or near the armature. A time delay circuit may be connected to the switch.

19 Claims, 2 Drawing Sheets

ALIGNMENT DEVICE FOR ELECTROMAGNETIC DOOR LOCK

BACKGROUND OF THE INVENTION

1. FIELD OF THE INVENTION

The present invention generally relates to locking mechanisms and, more particularly, to an improved electromagnetic door lock device.

2. PRIOR ART

There are a large number of different types of electromagnetic door locks, most of which are complicated and expensive to manufacture, install and service and many of which do not perform efficiently. One particular lock as for example is shown in U. S. Pat. No. 4,487,439 which issued on Dec. 11, 1984, to William C. McFadden and entitled Magnetic Shear Locking Methods and Apparatus utilizes a locking mechanism which operates under shear. However, this device utilizes a specially configured electromagnet. When an armature is attracted thereto during locking, a small central tab on the electromagnet extends into a central armature dimple to prevent the armature and the door to which it is attached from moving. Such an electromagnet configuration is expensive to make. Moreover, great care must be made to align the armature and electromagnet, specifically, the central dimple and tab, otherwise the lock will malfunction. Of more importance, consideration shear stress can occur to the electromagnet with resultant cracking and disruption of the electromagnet, particularly if an attempt is made to force the door open while it is in the locked position. Finally, the device is not adapted to a wide variety of applications. Although the electromagnetic door lock device of U. S. Pat. No. 4,826,223 satisfies most of the problems connected with prior art door locks, it still has a problem of properly aligning its electromagnet and movable armature before energizing the electromagnet. Energizing the electromagnet before proper armature alignment can cause improper locking or non-locking of the door.

Accordingly, there is a need for an improved, less expensive, more durable and efficient electromagnetic door locking device which will assure positive door locking and positive armature-electromagnet alignment. Such device should be simple to make, install, inspect, repair and replace. It should also be designed to protect the electromagnet against damage if the lock is forced. In addition, the device should be capable of being utilized for one-way and two-way swinging doors, sliding doors and windows and in applications where the lock is to be connected to the door frame at either the side, top, or bottom of the door.

SUMMARY OF THE INVENTION

The improved electromagnetic door locking device of the present invention satisfies all the foregoing needs. The device is substantially as set forth in the Abstract above. Thus, the device employs an electromagnet in a fixed position on the top or side of a door frame. The electromagnet generally has a relatively flat side adapted to face the opening defined by the door frame.

The device also includes an armature in the form of a plate or the like which is attracted to the electromagnet when the latter is energized. The armature can be mounted on the edge of a door in the frame so that it is aligned with and faces the electromagnet when the door is closed. The assembly which mounts the armature on the door is adjustable so that when the armature is magnetically attracted to the electromagnet it freely moves toward it, engaging a lock component carried by the outer periphery of the armature and/or electromagnet housing with the other of the armature-electromagnet pair. The lock component automatically disengages when the electromagnet is deenergized, because the armature then automatically retracts by gravity or spring action from proximity to the electromagnet.

Of more importance, armature-electromagnet alignment sensing means are provided. They comprise one or more spaced magnets associated with the armature assembly or in the surface facing the electromagnet and one or more switches in an adjoining surface of the electromagnet and held in a normally open circuit position but movable to a closed circuit position. The switches are connected into means for energizing the electromagnet, magnet, so that the latter cannot be energized to lock the door until the switch or switches are activated. This is accomplished by fully aligning the armature magnet or magnets with the switch or switches to attract them into the closed position. This insures the magnet and armature are aligned properly before the electromagnet is energized. Usually, only one armature magnet and one switch is used. The switch may also be connected to a time delay circuit, in turn connected to the energizing means so that there is a delay between the time the switch is closed and the time the electromagnet can be energized.

In one embodiment, the switch is a reed switch disposed in the electromagnet surface facing the armature. In another embodiment, the switch is a pair of spaced contacts in a slide space in the housing with a magetically attractable bar suspended in the space and slidable by magnetism to a position bridging the contacts.

The armature magnet can be located in an opening in the armature or it can be located adjacent to the armature. The armature magnet can be associated with adjustment means to afford precise adjustment of same in all directions for optimum sensitivity.

Further featues of the invention are set forth in the following detailed description and accompanying drawings.

DRAWINGS

DETAILED DESCRIPTION

FIGS. 1-4

Figure 1:
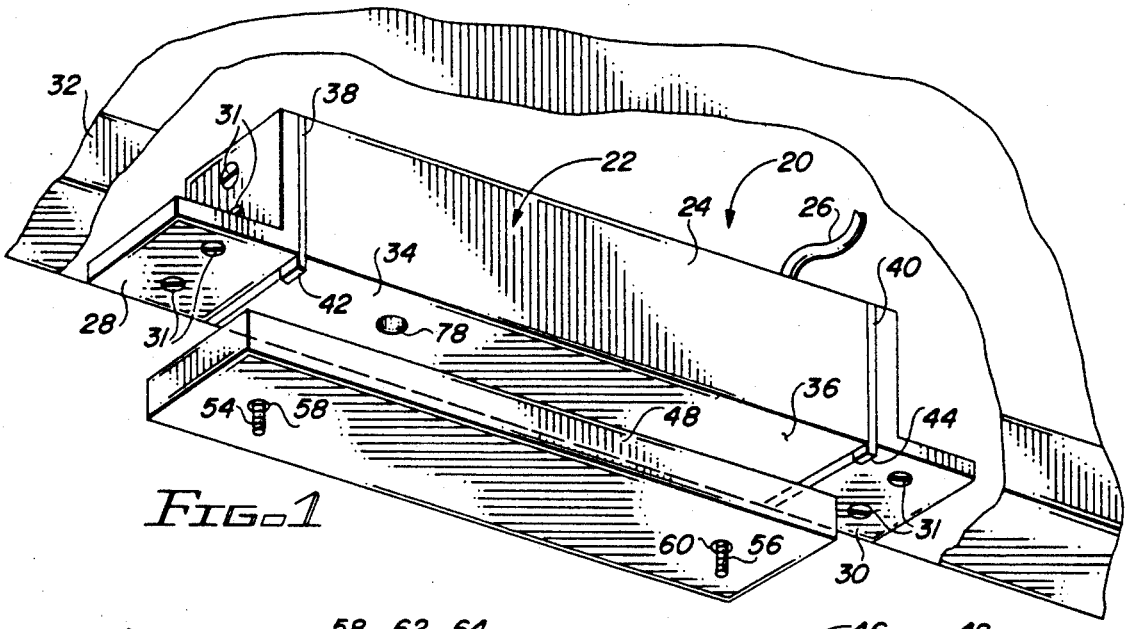
FIG. 1 is a schematic perspective view of a first preferred embodiment of the improved locking device of the present invention, showing the electromagnet thereof mounted in the top of a door frame.
Figure 2:
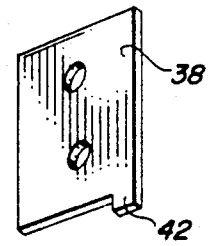
FIG. 2 is a schematic side elevation, partly broken away, of the armature of FIG. 1 adjustably connected to the top of a door.

A first preferred embodiment of the improved locking device of the invention is shown in FIGS. 1-4. Thus, device 20 is depicted, which comprises an electromaget 22 disposed in a rectangular housing 24 and connected via an electrical circuit 26 with a remote power source (not shown). Electromagnet 22 can be of any conventional construction and is shown mounted to a pair of L-shaped brackets 28 and 30 by screws generally designated 31, and by screws 31 and brackets 28 and 30 to the underside of a door frame 32 so that one flat side 34 of housing 24 faces the opening 36 defined by frame 32.

Device 20 also includes a pair of flat locking plates 38 and 40, preferably of non-magnetic metal, mounted between brackets 28 and 30 respectively, and bearing tabs 42 and 44 depending from the front edges thereof.

Device 20 also includes an armature 46 in the form of an elongated rectangular plate 48 which is magnetically attracted to electromagnet 22 when the latter is energized. Plate 48 is shown in FIG. 3 mounted on the top edge 50 of a door 52 disposed in opening 36 of frame 32 (see FIG. 1) and hinged to swing on one side of frame 32.

A spaced pair of screws 54 and 56 are disposed in unthreaded openings 58 and 60, respectively, in plate 48. Openings 58 and 60 have expanded upper portions 62 to freely accommodate the expanded heads 64 of screws 54 and 56. Threaded openings 66 in door 52 adjustably receive the shanks 68 of screws 54 and 56, so that the spacing and free play between plate 48 and edge 50 can be adjusted by adjusting the height of screws 54 and 56 in door 52. Thus, the extent that plate 48 can move toward side 34 of electromagnet 22 when magnetically attracted thereto can be very readily adjusted by screws 54 and 56.

It will be noted that when electromagnet 22 is energized and plate 48 is aligned directly therebelow, that is, when door 52 is closed in frame 32, plate 48 moves up towards side 34 sufficiently far to lie forward of and abutting tabs 42 and 44. Thus, door 52 is prevented from opening, tabs 42 and 44 acting as locking components. So long as electromagnet 22 remains energized, plate 48 remains trapped by tabs 42 and 44, and door 52 remains locked.

Figure 3:
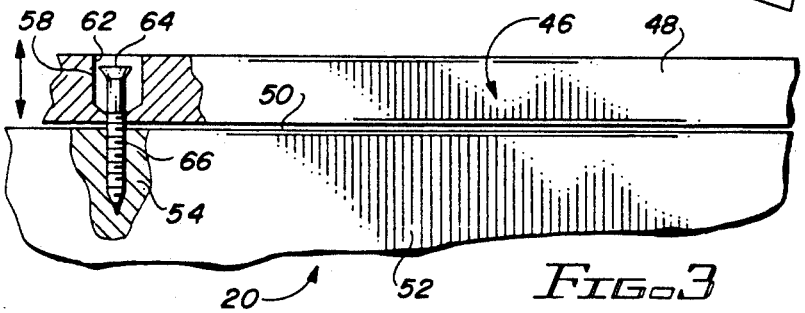
FIG. 3 is an enlarged schematic side elevation, partly broken away, of the armature of FIG. 1 adjustably connected to the top of a door.
Figure 4:
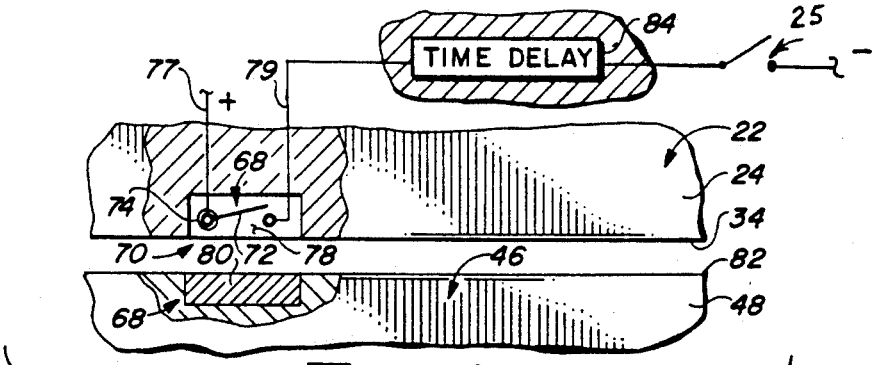
FIG. 4 is an enlarged, fragmentary, schematic side elevation, partly broken away, of a first preferred embodiment of the improved automatic armature-electromagnet alignment sensing means utilized in the device of FIG. 1.

When electromagnet 22 is deenergized, plate 48 automatically falls by gravity to the position shown in FIG. 3 on top of door edge 50, thus clearing the bottom of tabs 42 and 44 and allowing door 52 to open. With this locking arrangement, no damage is done to relatively costly electromagnet 22 or housing 24 if door 52 is forced open while locked. The forcing stress all occurs in locking plates 38 and 40, which are inexpensive and are easily and quickly replaced. They are also easily reversed, so as to work effectively with a door hinged to open from the opposite directions. Moreover, tabs 42 and 44 are well spaced apart and have much greater holding power than a single central tab in certain prior art devices.

Device 20 also includes alignment sensing means 68 for electromagnet 22 and armature 46. Thus, housing 24 includes reed switch 70 having a magnetically attractable reed or blade 72 suspended by a spring 74 above or adjacent to a contact 76 in a space 78 in the bottom or exposed surface 34 of housing 24. Electrical leads 77 and 79 lead from reed 72 and contact 76 to electrical circuitry hereinafter described. A permanent magnet 80 is disposed through the top surface 82 of plate 48 of armature 46 and is fully alignable with switch 70 only when door 52 is fully closed.

In that position, magnet 80 attracts reed 72 to the closed circuit position through contact 76 and completing the circuit between the conduit 26 and electromagnet 22. Conduit 26 is in turn connected to a time delay circuit 84 in housing 24 so that electromagnet 22 is only energizable when switch 25 is closed and switch 70 and magnet 80 are fully aligned, thus assuring full alignment of armature 46 and housing 24 for full locking. This locking arrangement is effected on a time delay basis via circuit 84 so as to enable armature 46 with magnet 80 to be stationary and fully in place adjacent housing 24 before locking proceeds by energizing electromagnet 22 and attracting armature 46 up to the locked position against housing 24 between brackets 28 and 30 and against tabs 42 and 44. When deenergization takes place and door 52 is opened, magnet 80 moves away from reed 72 and switch 70 opens, automatically due to the action of spring 74.

Accordingly, device 20 has improved utility and simplicity. Its components can be fabricated of suitable, durable, inexpensive metal, such as steel or the like, and other materials. It provides improved smooth position locking and unlocking for optimal results.

FIG. 5

Figure 5:
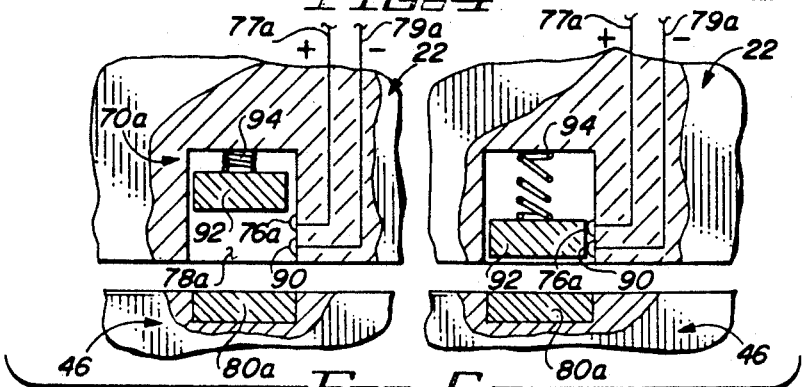
FIG. 5 is an enlarged, fragmentary, schematic side elevation, partly broken away, of a second preferred embodiment of the improved armature-electromagnet alignment sensing means utilized in the device of FIG. 1, FIG. 5(*a*) showing the switch thereof in the open circuit position and FIG. 5(*b*) showing the switch in the closed circuit position.

A second preferred embodiment of the improved armature-electromagnet alignment sensing means of the present invention is schematically depicted in FIG. 5. Thus, sensing means 68*a* are shown in FIG. 5 disposed in device 20 in place of aligning means 68. Components thereof similar to those of means 68 bear the same numerals but are succeeded by the letter "a".

Means 68*a* is identical to means 68 except as follows: reed switch 70 is replaced by a switch 70*a* having vertically spaced contacts 76*a* and 90 disposed in space 78*a*, together with a magnetically attractable slide plate or bar 92 suspended vertically by a spring 94 above and away from contacts 76*a* and 90 (FIG. 5(*a*) but movable by magnet attraction toward magnet 80 a into a position bridging contacts 76*a* and 90 (FIG. 5(b)) and thus closing the circuit cf switch 70*a*. Switch 70*a* performs similarly to switch 70 in device 20.

FIGS. 6 & 7

Figure 6:
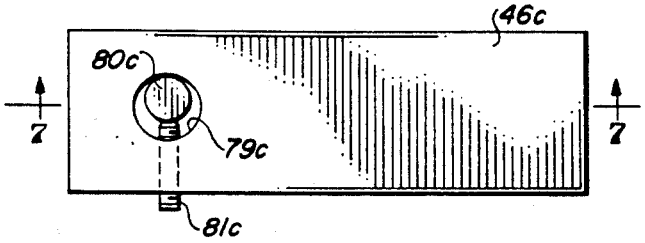
FIG. 6 is a plan view showing the armature magnet disposed within an opening in the armature and secured thereto.
Figure 7:
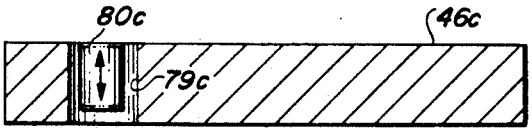
FIG. 7 is a cross-sectional view of the assembly of FIG. 6, taken along lines A—A.

Another preferred embodiment of the improved armature alignment sensing means of the present invention is shown in FIGS. 6 and 7. However, in this embodiment provision is made for adjusting the position of magnet 80. Components similar to those of FIG. 5 bear the same numeral but are succeeded by the letter "c".

The armature assembly is identical to the embodiment of FIG. 5 except that the magnet 80*c* floats in a slot 79*c*. The position of magnet 80*c* within slot 79*c* can be varied, and held in a fixed, pre-selected position by set screw 81*c*. Sensitivity of the device can therefore be adjusted by varying the position of magnet 80*c* within slot 79*c*.

FIG. 8

Figure 8:
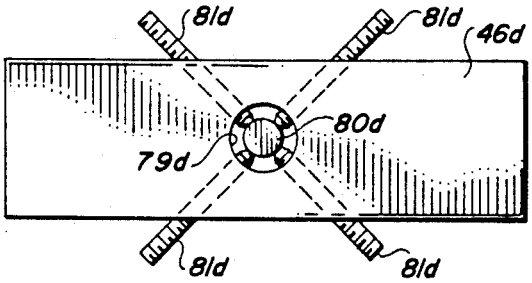
FIG. 8 is a plan view of another armature assembly showing a different magnet securing and positioning means.

FIG. 8 is a showing of an armature very similar to the assembly shown in FIGS. 6 and 7. However, a plurality of combination set-screw/positioning screws 81*d* are provided to allow vertical and horizontal positioning of magnet 80*d* with respect to armature 46*d*.

Figure 9:
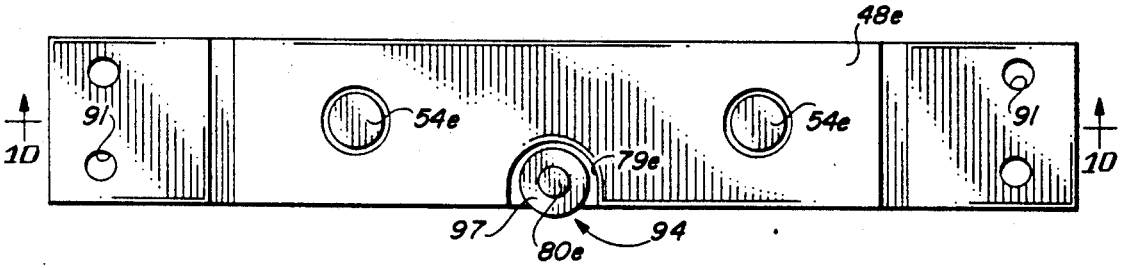
FIG. 9 is a plan view of the assembly with the magnet disposed within and passing through an opening in the armature, and being secured to a base plate which holds the armature.
Figure 10:
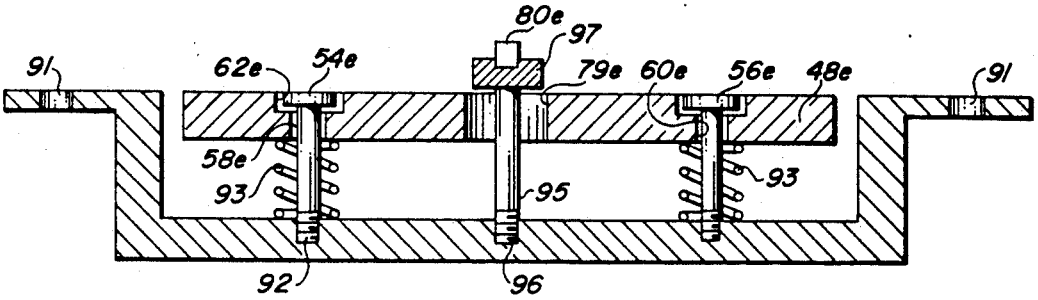
FIG. 10 is a cross-sectional view of the assembly of FIG. 9 taken along lines A—A of FIG. 9.

FIGS. 9 and 10

Another preferred embodiment of the improved armature alignment sensing means of the present invention is shown in FIGS. 9 and 10. However, in this embodiment, the magnet is not attached to the armature. Components similar to those of FIG. 5 bear the same numerals but are succeeded by the letter (e).

In this embodiment a base plate 90 is provided which can be secured to a recess (not shown) in the top of a door by appropriate fastening means (not shown) passing through openings 91.

Armature 48*e* is secured to base plate 90 by screws 54*e* and 56*e* through openings 58*e* and 60*e* in armature 48*e* to recesses 92 provided in base plate 90. Armature 48*e* can be held suspended above base plate 90 by springs 93.

Armature 48*e* has an opening 79*f* therein through which magnet assembly 94 passes. Magnet assembly 94 includes a rotatable bolt 95 screwed into opening 96 in base plate 90, magnet retention member 97 and magnet and magnet 80*e*. The height of magnet 80*e* above base plate 90 can be simply adjusted by turning screw 95 into opening 96, thereby varying the sensitivity of the device.

Various other modifications, changes, alterations and additions can be made in the improved device of the present invention, its components and their parameters. All such modifications, changes, alterations and additions as are within the scope of the appended claims form part of the present invention.

What is claimed is:

1. An improved electromagnetic door lock device, said device comprising, in combination:

a) a door frame, b) an electromagnet secured to said door frame, c) electromagnetic energization means including a power source and electrical conduit means connecting said power source to said electromagnet, d) a door movably secured to said door frame and movable relative thereto to open and close said door, e) an armature secured to said door at a position substantially opposite said electromagnet when said door is in a closed position, said armature being magnetically attracted to said electromagnet only when said electromagnet is energized by said energization means, f) said armature being secured to said door by adjustable connector means which permit movement of said armature between (i) an extended position towards and in substantially intimate contact with said electromagnetic when attracted thereto; and (ii) a retracted position away from said electromagnet when not attracted thereto, and g) armature electromagnet alignment sensing means, h) switch means associated with said sensing means and connected to said energization means, i) said switch means being movable into a first circuit position which prevents said electromagnet from being energized by said energization means, and movable into a second position upon substantial alignment of said armature and said electromagnet to allow energization of said electromagnet energizing means.

2. The improved device of claim 1 wherein said electromagnet is suspended from the header of said door frame, wherein said electromagnet includes a housing having a smooth side facing an opening defined by said door frame, wherein said connector means connects said armature to the top edge of said door, and wherein said armature returns to the retracted position by gravity when not attracted to said electromagnet.

3. The improved device of claim 1 including locking means releasably connected to said electromagnet for preventing opening of said door when the electromagnet is energized.

4. The improved device of claim 3 wherein said locking means comprises at least one plate connected to the side of said housing, said plate including a projecting tab at one end thereof adapted to trap said armature and lock said door.

5. The improved device of claim 3 wherein said locking means comprises a pair of plates disposed against opposite sides of said housing and depending therefrom.

6. The device of claim 1 wherein said sensing means includes a permanent magnet.

7. The improved device of claim 6 wherein said permanent magnet is carried by said armature and wherein said switch means is adjacent to the surface of said electromagnet facing said armature, and wherein said alignment of said armature magnet and switch means assures proper alignment of said armature and electromagnet for smooth positive door locking and unlocking.

8. The improved device of claim 7 wherein said switch means includes a magnetically attractable reed switch.

9. The improved device of claim 7 wherein there are a plurality of said armature magnets in said permanent and a plurality of said switch means in said electromagnet simultaneously alignable with said permanent magnets.

10. The improved device of claim 7 wherein said switch means includes a time delay circuit.

11. The improved device of claim 6 including means for varying the sensitivity of said sensing means.

12. The improved device of claim 11 wherein said positioning means includes a mechanism to allow movement of the armature in a vertical and/or horizontal direction with respect to the armature.

13. The improved device of claim 6 wherein the permanent magnet is positioned within an opening in the armature.

14. The improved device of claim 6 wherein the permanent magnet is positioned adjacent to said armature.

15. The improved device of claim 6 wherein the permanent magnet is secured to said armature.

16. An improved electromagnetic door lock device, said device comprising, in combination:

a) a door frame, b) an electromagnet secured to said door frame, c) electromagnetic energization means including a power source and electrical conduit means connecting said power source to said electromagnet, d) a door movably secured to said door frame and movable relative thereto to open and close said door, e) an armature secured to said door at a position substantially opposite said electromagnet when said door is in a closed position, said armature being magnetically attracted to said electromagnet only when said electromagnet is energized by said energization means, f) said armature being secured to said door by adjustable connector means which permit movement of said armature between (i) an extended position towards and in substantially intimate contact with said electromagnet when attracted thereto; and (ii) a retracted position away from said electromagnet when not attracted thereto, g) armature electromagnet alignment sensing means, said means comprising a permanent-magnet connected to said armature, and switch means in said electromagnet in a first circuit position, but movable into a second circuit position by magnetization when said armature magnet is aligned therewith and proximate thereto, said switch means being connected to said energization means whereby said electromagnet can be energized, only when said switch means is in a second circuit position, h) wherein said permanent magnet is carried by said armature and wherein said switch means is adjacent to the surface of said electromagnet facing said armature, and wherein said alignment of said armature magnet and switch means assures proper alignment of said armature and electromagnet for smooth positive door locking and unlocking, i) wherein said switch means includes spaced pair of electrical contacts projecting into a space in said electromagnet, and a spring-suspended bar disposed in the resting position in said space adjacent to said spaced pair of contacts but magnetically attractable by said permanent magnet to a closed contact position in said space bridging both said contacts.

17. An improved electromagnetic door lock device, said device comprising, in combination:

a) a door frame, b) an electromagnet secured to said door frame, c) electromagnet energization means including a power source and electrical conduit means, d) a door movably secured to said door frame and movable relative thereto to open and close said door, e) an armature secured to said door at a position substantially opposite said electromagnet when said door is in a closed position, said armature being magnetically attracted to said electromagnet only when said electromagnet is energized by said energization means, f) said armature being secured to said door by adjustable connector means which permit movement of said armature between (i) an extended position towards and in substantially intimate contact with said electromagnet when attracted thereto, and (ii) a retracted position away from said electromagnet when not attracted thereto, and g) armature electromagnet alignment sensing means, said means comprising a permanent-magnet connected to said armature, and switch means in said electromagnet in a first circuit position, but movable into a second circuit position by magnetization when said armature magnet is aligned therewith and proximate thereto, said switch means being connected to said energization means whereby said electromagnet can be energized, only when said switch means is in a second circuit position, h) including means for varying the sensitivity of said sensing means, i) wherein positioning means are included to vary the sensitivity of said sensing means by changing the position of said permanent magnet with respect to said armature.

18. An improved electromagnetic door lock device, said device comprising, in combination:

a) a door frame, b) an electromagnet secured to said door frame, c) electromagnet energization means including a power source and electrical conduit means connecting said power source to said electromagnet, d) a door movably secured to said door frame and movable relative thereto to open and close said door, e) an armature secured to said door at a position substantially opposite said electromagnet when said door is in a closed position, said armature being magnetically attracted to said electromagnet only when said electromagnet is energized by said energization means, f) said armature being secured to said door by adjustable connector means which permit movement of said armature between (i) an extended position towards and in substantially intimate contact with said electromagnet when attracted thereto; and (ii) a retracted position away from said electromagnet when not attracted thereto, and g) armature electromagnet alignment sensing means, said means comprising a permanent-magnet connected to said armature, and switch means in said electromagnet in a first circuit position, but movable into a second circuit position by magnetization when said armature magnet is aligned therewith and proximate thereto, said switch means being connected to said energization means whereby said electromagnet can be energized, only when said switch means is in a second circuit position h) wherein the permanent magnet is secured to said armature, and i) including a base plate, means for suspending said armature away from said base plate, and means to adjustably secure said magnet to said base plate.

19. An improved electromagnetic door lock device, said device comprising, in combination:

a) a door frame, b) an electromagnet secured to said door frame, c) electromagnet energization means including a power source and electrical conduit means connecting said power source to said electromagnet, d) a door movably secured to said door frame and movable relative thereto to open and close said door, e) an armature secured to said door at a position substantially opposite said electromagnet when said door is in a closed position, said armature being magnetically attracted to said electromagnet only when said electromagnet is energized by said energization means, f) said armature being secured to said door by adjustable connector means which permit movement of said armature between (i) an extended position towards and in substantially intimate contact with said electromagnet when attracted thereto; and (ii) a retracted position away from said electromagnet when not attracted thereto, and g) armature electromagnet alignment sensing means, said means comprising a permanent-magnet connected to said armature, and switch means in said electromagnet in a first circuit position, but movable into a second circuit position by magnetization when said armature magnet is aligned therewith and proximate thereto, said switch means being connected to said energization means whereby said electromagnet can be energized, only when said switch means is in a second circuit position, h) wherein the permanent magnet is secured to said armature, i) including a base plate, means for suspending said armature away from said base plate, and means to adjustably secure said magnet to said base plate, and j) wherein movement of said permanent magnet and armature are independent.

* * * * *